US005127879A

United States Patent [19]

Schubert

[11] Patent Number: 5,127,879

[45] Date of Patent: Jul. 7, 1992

[54] APPARATUS FOR RECORDKEEPING

[76] Inventor: Keith E. Schubert, 4 Timothy Rd., Norwalk, Conn. 06850

[21] Appl. No.: 334,183

[22] Filed: Apr. 6, 1989

[51] Int. Cl.[5] ..... B41L 1/26

[52] U.S. Cl. ..... 462/2; 281/15.1; 281/2; 281/5; 462/8; 462/6; 462/17; 462/25; 462/84; 462/54; 462/55; 462/56

[58] Field of Search ..... 283/66.1, 62, 61, 117, 283/103, 105; 282/12 A, 12 R, 8 R, 1 R, 3 R, 2, 22 R, 15 B, 18 A, 11.5 R; 281/15.1, 2, 5, 29, 35, 51

[56] References Cited

U.S. PATENT DOCUMENTS

| | | | |
|---|---|---|---|
| Re 30,041 | 7/1979 | Maalouf | 282/27.5 |
| Re 30,116 | 10/1979 | Maalouf | 282/27.5 |
| Re 31,695 | 10/1984 | Zink | 427/211 |
| 371,126 | 10/1887 | Currie . | |
| 396,560 | 1/1889 | Harrison | 283/66.1 |
| 418,455 | 12/1889 | Gray . | |
| 419,359 | 1/1890 | Rogers | 282/12 A |
| 445,368 | 1/1891 | Campbell . | |
| 765,408 | 7/1904 | Wildey . | |
| 1,187,682 | 6/1916 | Trueman | 282/12 R |
| 1,301,834 | 4/1919 | Gilman | 282/12 R |
| 1,980,318 | 11/1934 | Caton | 282/26 |
| 2,093,086 | 9/1937 | Luzzatto | 282/27 |
| 2,098,706 | 11/1937 | Lawson et al. | 282/12 A |
| 2,194,670 | 3/1940 | Neu | 282/27 |
| 2,211,532 | 8/1940 | Biggs | 282/12 R |
| 2,220,842 | 11/1940 | Hano | 282/12 A |
| 2,264,119 | 8/1940 | Lichter . | |
| 2,458,729 | 1/1949 | Politzer | 283/63.1 |
| 2,470,586 | 5/1949 | Tathwell | 282/9 |
| 2,637,571 | 5/1953 | Tilly . | |
| 2,694,429 | 11/1954 | Berger . | |
| 2,802,678 | 8/1957 | Bright | 282/22 |
| 2,869,898 | 1/1959 | Martin | 252/27 |
| 3,625,547 | 12/1971 | Burke | 282/23 |
| 3,981,523 | 4/1976 | Maalouf | 282/27.5 |
| 4,000,916 | 1/1977 | Lucas | 282/11.5 A |
| 4,036,511 | 2/1977 | Maalouf | 282/27.5 |
| 4,039,046 | 8/1977 | D'Luhy | 282/22 R |
| 4,056,191 | 11/1977 | Weisenfluh | 206/629 |
| 4,062,567 | 12/1977 | Macaulay | 282/27.5 |
| 4,126,334 | 11/1978 | Van Malderghem | 282/22 R |
| 4,138,302 | 2/1979 | D'Luhy | 156/216 |
| 4,143,891 | 3/1979 | Neubauer | 282/27.5 |
| 4,343,494 | 10/1982 | Erhardt et al. | 282/27.5 |
| 4,354,449 | 10/1982 | Zink | 118/126 |

(List continued on next page.)

FOREIGN PATENT DOCUMENTS

| | | | |
|---|---|---|---|
| 549442 | 4/1932 | Fed. Rep. of Germany | 282/12 R |
| 613658 | 11/1926 | France | 282/12 |
| 2085359 | 4/1982 | United Kingdom . | |

OTHER PUBLICATIONS

Tagmaster AD for Magnetic-Index (1 p.).
Money Magazine, Feb. 1989 (3 pp.).
"Pressure-Sensitive Papers", Project 2558 Tappi Coating Committee, Dec. 1967.
"Pressure-Sensitive Papers", Project 2558, Weiner and Roth, Tappi Coating Committee, 1965.

*Primary Examiner*—Paul A. Bell
*Attorney, Agent, or Firm*—Gerald E. Linden

[57] ABSTRACT

A recordkeeping book has a front cover, a back cover and an accordion-folded strip of paper extending therebetween. The strip is divided longitudinally into a "left" portion, disposed within the covers, and a "right" portion, extending out from the covers. Information entered on the front surface of the left portion is reproduced on the back surface of the right portion when the right portion is folded underneath the left portion. Information entered on the back surface of the left portion is reproduced on the front surface of the right portion when the right portion is folded over the left portion. Means for effecting the reproduction of information entered on both surfaces of the left portion onto both surfaces of the right portion are disclosed and include a "male", or "CB" carbonless copy treatment applied to the front and back surfaces of the left portion, and a "female" or "CF" carbonless copy treatment applied to the front and back surfaces of the right portion. Method and apparatus are disclosed.

9 Claims, 7 Drawing Sheets

U.S. PATENT DOCUMENTS

| | | | |
|---|---|---|---|
| 4,381,120 | 4/1983 | Golden | 282/27.5 |
| 4,407,524 | 10/1983 | Trautlein | 282/9 R |
| 4,448,445 | 5/1984 | Chang et al. | 346/206 |
| 4,501,559 | 2/1985 | Griswold | 283/66.1 |
| 4,512,595 | 4/1985 | Breen | 283/70 |
| 4,533,160 | 8/1985 | Malone | 282/23 R |
| 4,556,390 | 12/1985 | Rahn et al. | |
| 4,566,720 | 1/1986 | Goldman | 283/116 |
| 4,576,399 | 3/1986 | White et al. | 282/8 R |
| 4,583,765 | 4/1986 | Messinger | 282/9 |
| 4,614,362 | 9/1986 | Breen et al. | 282/9 |
| 4,614,363 | 9/1986 | Breen | 282/22 R |
| 4,642,662 | 2/1987 | Torii et al. | 346/215 |
| 4,657,783 | 4/1987 | Tatt et al. | 427/211 |
| 4,715,620 | 12/1987 | Thompson | 282/9 R |
| 4,722,553 | 2/1988 | Evans | 282/9 |
| 4,762,342 | 8/1988 | Thompson | 282/9 R |

APPARATUS FOR RECORDKEEPING

TECHNICAL FIELD OF THE INVENTION

The invention relates to method and apparatus for recordkeeping, and more particularly to keeping records of valuable assets.

BACKGROUND OF THE INVENTION

In the aftermath of a death, it would surprise most people to find out how many bank accounts go unclaimed, or the number of shares of stock which remain on deposit with a broker, because the next of kin are unaware of their existence. It is often the case that the more successful a person becomes, the less time that person spends with the personal business of preparing a simple list of what assets they have and where they are kept. Furthermore, people often forget to make a record of such items as a fur coat in storage, a credit union account with automatic payroll deduction. Even in the case where such a list has been prepared, the question arises of what to do with the list, in other words where should the list be kept so that it is readily accessible to the next of kin.

In the February 1989 issue of "Money" magazine, in an article entitled "Why You Need a Way to the Will", it is suggested that people need a "document locator", or detailed list of everything a survivor needs to know but is too polite to ask. However, the essential question remains unanswered, which is how does the survivor find, or in some cases even know of, the document locator. It will be evident hereinafter that the present invention, when used as suggested, answers this question.

The recordkeeping system of the present invention was designed to answer these questions in a manner that is useful to all types of working, non-working and retired people. The step-by-step instructions and data sheets cover items that many people would otherwise forget to account for. With a small investment of time, the user of this invention will enjoy a feeling of security, knowing that upon his passing certain matters will be more readily attended to.

INFORMATION DISCLOSURE STATEMENT

U.S. Pat. No. 371,126 discloses a duplex time ticket wherein an original and a duplicate ticket are in exact register. Entries are punched in both tickets simultaneously so that the duplicate agrees with the original.

U.S. Pat. No. 396,560 discloses a tax receipt blank which is printed on a single piece of paper consisting of an original receipt-blank, a brief duplicate coupon at one end of the original and a brief duplicate stub at the opposite end of the original. Both the coupon and the stub are divided from the blank by a perforated line.

U.S. Pat. No. 418,455 discloses an educational globe having two equal hemispherical sections and forming within the globe a compartment containing a folded strip of material bearing pictures.

U.S. Pat. No. 445,368 discloses a railroad mileage ticket including a continuous strip with a central longitudinal row of perforations dividing the strip into two portions. One portion is the ticket proper, and the other portion represents a duplicate check or voucher. Both portions are marked identically.

U.S. Pat. No. 2,264,119 discloses an indexed book, such as for listing telephone numbers or addresses, wherein the pages of the booklet are fabricated from a single sheet of material suitable scored and folded. The sheet of material is essentially trapezoidal and is folded in opposite directions to produce an accordian-shaped or zig-zag series of pages.

U.S. Pat. No. 2,458,729 discloses a book box consisting of accordion-folded pages in a box.

U.S. Pat. No. 2,637,571 discloses a check booklet comprising front and rear cover members and a series of check blanks integrally joined together and to one of the covers.

U.S. Pat. No. 2,694,429 discloses a pass case, i.e. to a pocket size display folder for such items as photographs.

U.S. Pat. No. 4,501,559 discloses a process of recording, numbering and indexing genealogical records using pieces of paper including a basic surname chart, individual family charts, and personal information charts. Each chart is marked in a particular manner suited to the information that it is intended to contain.

U.S. Pat. No. 4,556,390 discloses an adult/child communication kit for organizing and encouraging communications between a child and an adult and including a plurality of sets of stationary, each set tailored to a specific month of the year.

The Tagmaster company of Evanston, Ill. markets a magnetic index which comprises front and rear magnetic covers enclosing an accordion-folded strip of paper. The paper is attached at either end to one of the covers, and is marked with blank spaces for name, address and phone number.

None of these references, taken either alone or in combination, disclose or suggest the recordkeeping system of the present invention.

DISCLOSURE OF THE INVENTION

According to the invention, a recordkeeping book has a front cover, a back cover, and an accordion-folded strip of paper, or the like. The strip of paper has a "front" surface and a "back" surface, and is perforated, or the like, generally along a longitudinal centerline, thereby forming two portions, a "left" portion and a "right" portion. The accordion folds are parallel to each other and perpendicular to the longitudinal centerline, and define a plurality of "pages". The left portion extends longitudinally generally one page further than the right portion at either end of the strip, and the end pages so formed are attached to the inside surface of the front and back covers, respectively.

Further according to the invention, the front surface of the left portion is imprinted with a first group of headings, described hereinafter, as well as with a first set of blank spaces for filling in information. The back surface of the left portion is imprinted with a second group of headings, described hereinafter, as well as with a second set of blank spaces for filling in information. It should be understood that the blank spaces are defined by printed lines delineating an area where information is to be entered.

The back surface of the right portion is imprinted with the first group of headings and first set of blank spaces in a manner that the first set of blank spaces on the back surface of the right portion are in register with the first set of blank spaces on the front surface of the left portion when the right portion is folded "rearward" along the longitudinal centerline of the strip "under" the left portion.

Similarly, the front surface of the right portion is imprinted with the second group of headings and second set of blank spaces in a manner that the second set of blank spaces on the front surface of the right portion are in register with the second set of blank spaces on the back surface of the left portion when the right portion is folded "forward" along the longitudinal centerline of the strip "over" the left portion.

According to an aspect of the invention, the right portion is folded under the left portion and "first" information is entered in the first set of spaces on the front surface of the left portion. Means are provided for reproducing the first information, so entered on the front surface of the left portion, on the back surface of the right portion. The means for reproducing may be carbon paper, or the like.

Similarly, the right portion is folded over the left portion and "second" information is entered in the second set of spaces on the back surface of the left portion. Means are provided for reproducing the second information, so entered on the back surface of the left portion, on the front surface of the right portion. The means for reproducing may be carbon paper, or the like.

In an embodiment of the invention, the back surface of the left portion is treated with a "male" carbonless treatment and the back surface of the right portion is treated with a "female" carbonless treatment. In this manner, when the right portion is folded rearward along the centerline under the left portion and first information is entered in the first set of spaces on the front surface of the left portion, the first information is reproduced in the first set of spaces on the back surface of the right portion.

Similarly, the front surface of the left portion is treated with a male carbonless treatment and the front surface of the right portion is treated with a female carbonless treatment. In this manner, when the right portion is folded forward along the centerline over the left portion and second information is entered in the second set of spaces on the back surface of the left portion, the second information is reproduced in the second set of spaces on the front surface of the right portion.

Optionally, the left portion 24 is dissimilarly colored, such as white, from the right portion 26, which may be pink, in order to further distinguish the "copy" (right portion 26) from the "original" (left portion 24). This can be particularly important in the bulk production of paper for the strip 20 so that the paper will be imprinted in the proper orientation. Additionally, so that the book is assembled with the paper properly oriented, the right portion 26 can be imprinted with the legend "copy", as shown in FIG. 1.

One skilled in the art to which this invention most nearly pertains will appreciate the meanings of "male" and "female" carbonless treatments. They are commonly referred to as "CB" and "CF" coatings, respectively. The technology pertaining thereto is well known and is disclosed, for instance, in an article published by the Institute of Paper Chemistry entitled "PRESSURE-SENSITIVE PAPERS", an annotated bibliography, Project 2558 prepared for the Sensitized Papers Section, TAPPI Coating Committee, December, 1967, incorporated be reference herein, and in an article published by The Institute of Paper Chemistry entitled "PRESSURE-SENSITIVE PAPERS", Bibliographic Series No. 222, Project 2558, prepared by Jack Weiner and Lillian Roth under the sponsorship of the Sensitized Papers Section, TAPPI Coating Committee, 1965, invorporated by reference herein. These articles describe, for instance, a technique for coating one side of a paper (e.g., the "back" surface of an "original") with a low adhesive organic resin (e.g., a "male" carbonless treatment) which, in use, is opaque and of different, contrasting color than the paper (of a "copy") and coating one side of another paper (e.g., the "front" surface of the "copy") with a strongly adhering plasticized resin (e.g., a "female" carbonless treatment), whereupon the male treatment adheres to (e.g., images itself upon) the female treatment upon the application of pressure, i.e. in response to writing pressure applied to the front surface of the original. The inventor is aware only of this two-part (i.e., male/female) carbonless technology, but should a one-part technology exist or be developed (e.g., coating only the back surface of the original or the front surface of the copy), it is within the scope of this invention that one of the male/female treatments would be, in reality, not treatment per se, but rather a property of the paper itself (for instance, a low adhesive, opaque, contrasting treatment on the back surface of the original and a relatively high adhesive propensity of the copy paper, particularly the front surface thereof).

According to a feature of the invention, after the first and second information has been entered and reproduced, as described above, the right portion is separated from the left portion, thereby providing in the right portion a duplicate copy of the first and second information. The left portion, which has the front and back covers affixed thereto in book-like manner, is conveniently carried on the person, such as in a wallet. The right portion is kept elsewhere. The front and back covers, being magnetized, tend to hold the book, containing the left portion, together.

It is evident that the folding of the right portion forward and rearward along the centerline in the course of entering information in the spaces on the left portion prestresses the centerline perforations, thereby facilitating the separation of the right portion from the left portion.

According to an aspect of the invention, the width of the strip is generally twice that of the covers. In this manner the right portion extends out of the book when the strip is unfolded (along the centerline).

Further according to the invention, worksheets are provided with the book to assist the user in recalling and filling in information in the spaces provided. For instance, for filling in any of the spaces associated with a heading "Other", a list of possible other, for instance, fixed assets/property (page 34.10L) would be provided.

Other objects, features and advantages of the invention will become apparent in light of the following description thereof.

DETAILED DESCRIPTION OF THE INVENTION

Figure 1:
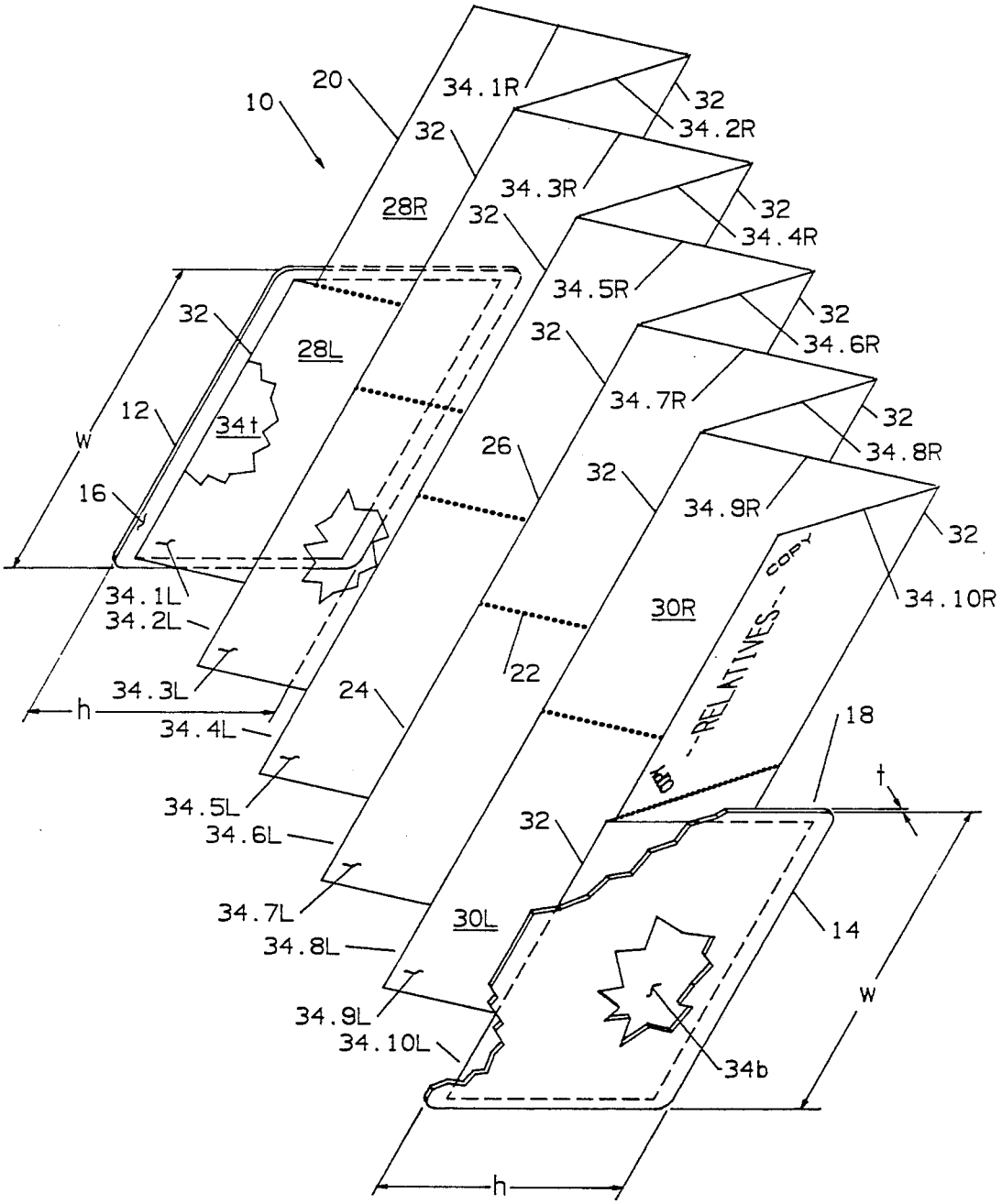
FIG. 1 is a perspective view, partially cutaway, of the recordkeeping book of this invention.

FIG. 1 shows the recordkeeping book 10 of this invention. The book has a front cover 12 and a back cover 14. The covers have a width, w, and a height, h, and are preferably magnetized as in the aforementioned Tagmaster address book. Each of the front and rear covers also have an inside surface 16 and 18, respectively.

A strip 20 of paper, or the like, extends between the front and back covers in the following manner. The strip has a longitudinal length, l, and a width substantially twice the width of the covers, or slightly less than 2 w. The strip has a longitudinal centerline 22 which divides the strip into two contiguous portions, a left portion 24 and a right portion 26. The centerline 22 is perforated, serrated, or the like, to permit the right portion to be separated from the left portion, as is discussed in greater detail hereinafter.

The strip 20 of paper is preferably 20-24# (pound) bond, with rag, and is preferably treated with a carbonless reproduction treatment, discussed hereinafter.

The strip 20 has a "front" surface 28, including a left front surface 28L and a right front surface 28R, and a "back" surface 30, including a left back surface 30L and a right back surface 30R, and is provided with accordion-like folds 32, which are parallel to each other and extend transversely across the width of the strip, perpendicular to the centerline. The folds define a plurality of pages 34, including pages 34.12L-34.12L on the left portion 24 of the strip 20 and corresponding pages 34.1R-34.12.R on the right portion 26 of the strip 20, which are imprinted as described hereinafter.

Figure 2:
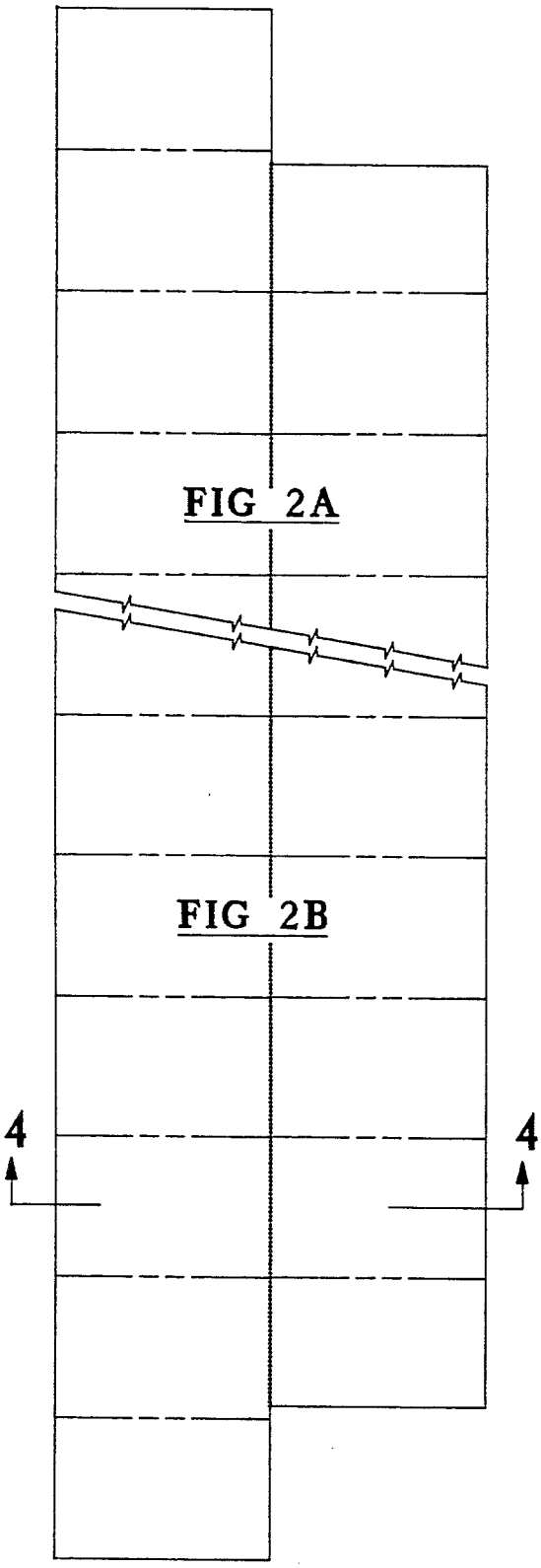
FIG. 2, comprising FIGS. 2A and 2B, as shown, is a plan view of the front surface of the strip employed in the book of FIG. 1.
Figure 3:
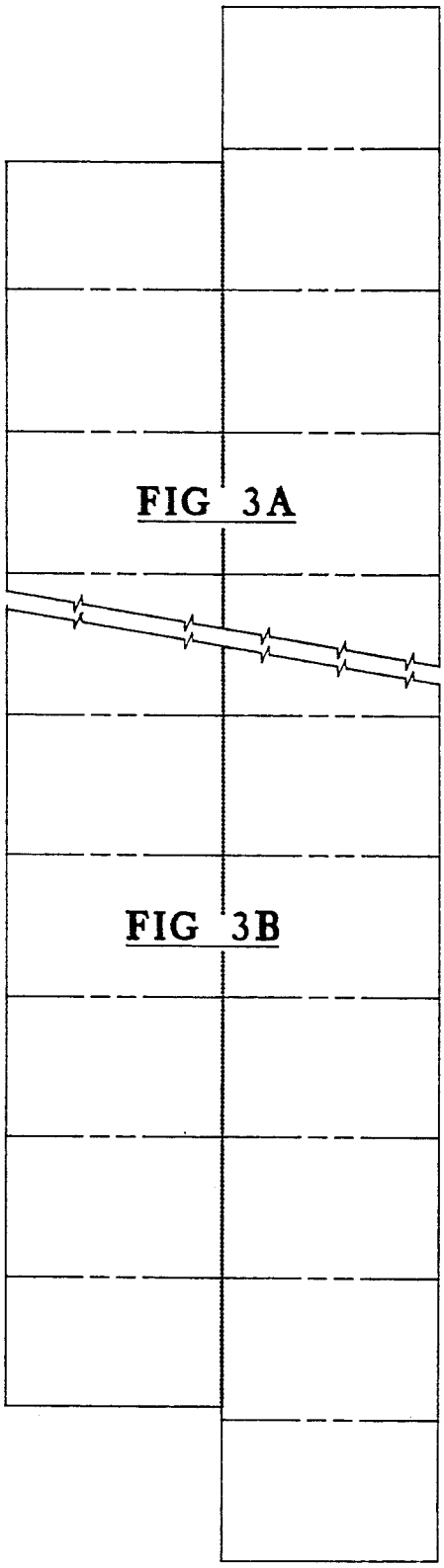
FIG. 3, comprising FIGS. 3A and 3B, as shown, is a plan view of the back surface of the strip employed in the book of FIG. 1.
Figure 2A:
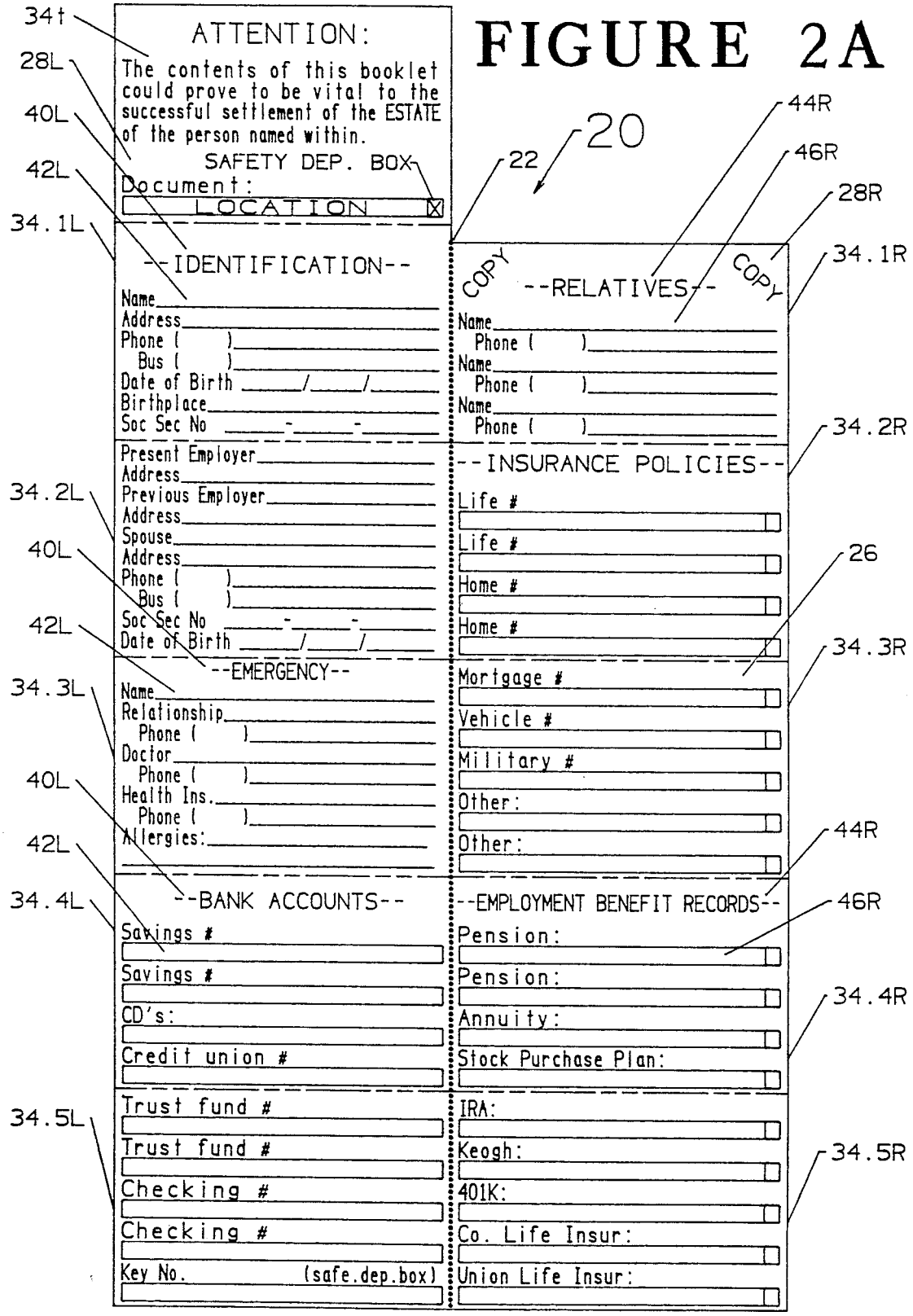
Figure 2B:
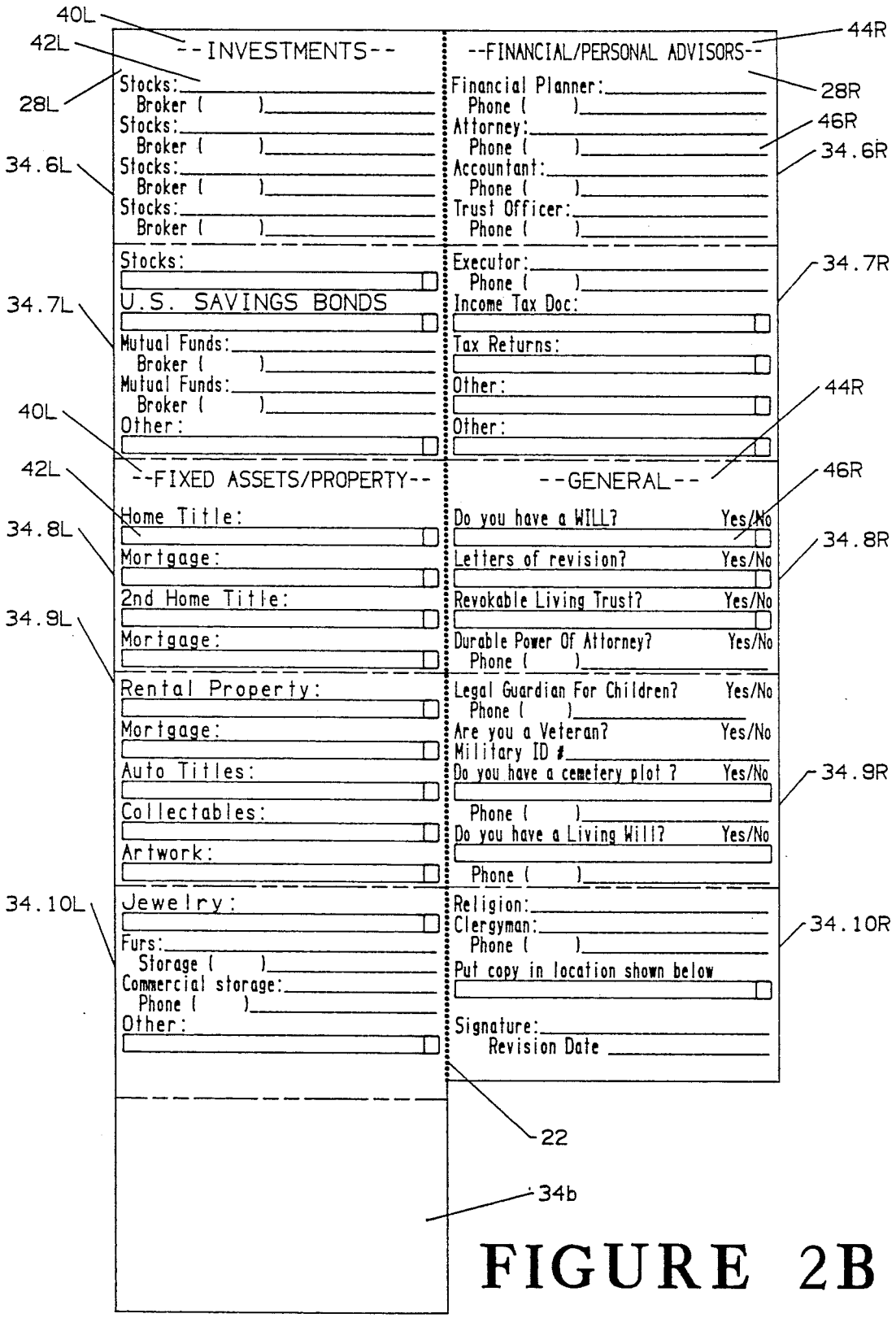
Figure 3A:
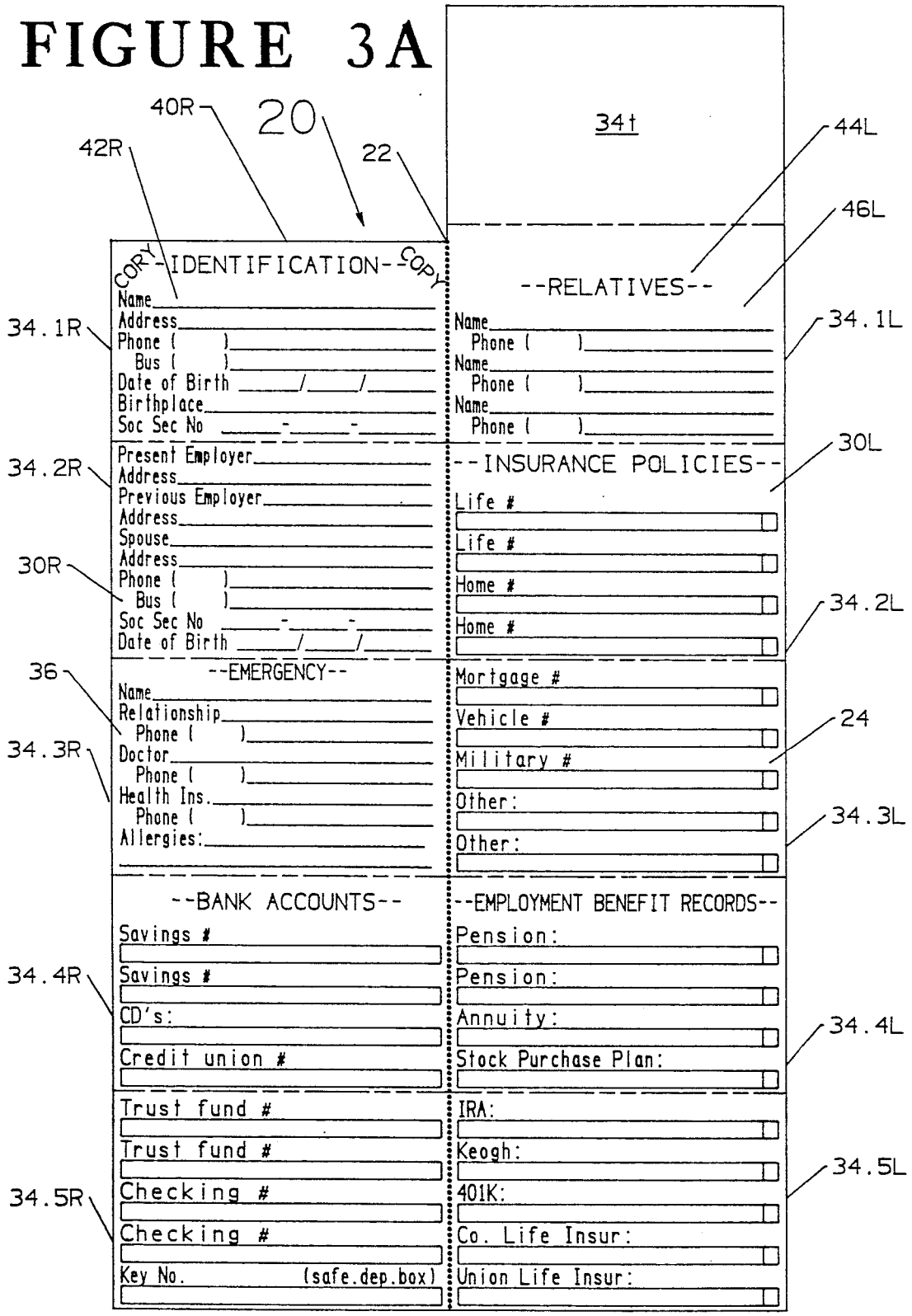
Figure 3B:
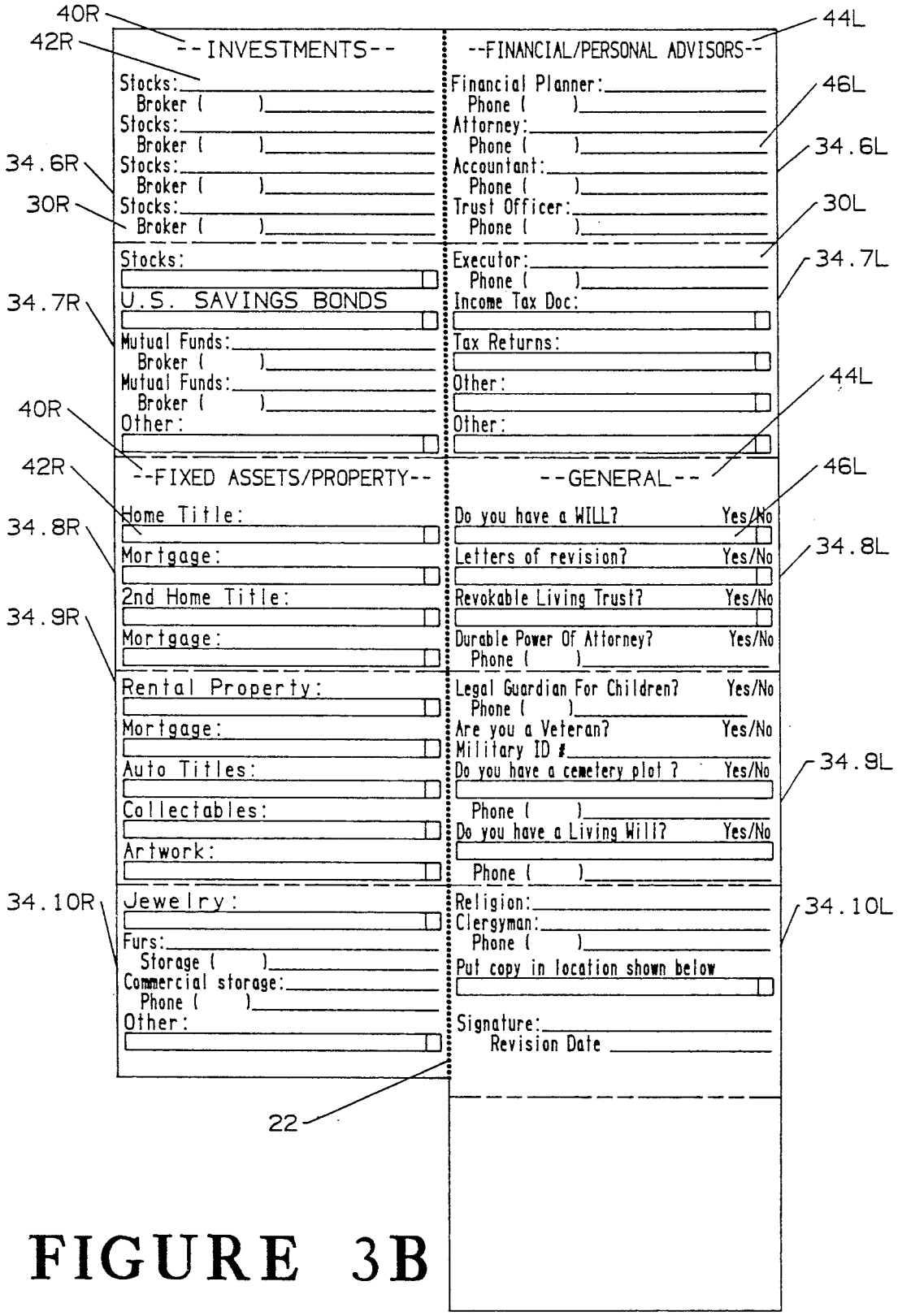

FIGS. 2 and 3 show the front surface 28 and back surface 30, respectively, of the strip 20. As shown in FIG. 2, the front surface 28L of the left portion 24 of the strip 20 is imprinted with a first group of headings 40L, described hereinafter, as well as with a first set of blank spaces 42L for entering first information related to the first group of headings. As shown in FIG. 3, the back surface 30L of the left portion 24 of the strip 20 is imprinted with a second group of headings 44L, described hereinafter, as well as with a second set of blank spaces 46L for entering second information related to the second group of headings.

As shown in FIG. 2, the front surface 28R of the right portion 26 of the strip 20 is imprinted with the second group of headings 44R, as well as with the second set of blank spaces 46R for reproducing second information entered in the second set of blank spaces 46L on the back surface 30L of the left portion 24. The second group of headings 44R on the front surface 28R of the right portion 26 is in longitudinal and transverse register with the second group of headings 44L on the back surface 30L of the left portion 24 when the right portion 26 is folded along the centerline 22 "over" the left portion 24. The second set of blank spaces 46R on the front surface 28R of the right portion 26 is in longitudinal and transverse register with the second set of blank spaces 46L on the back surface 30L of the left portion 24 when the right portion 26 is folded along the centerline 22 over the left portion 24.

As shown in FIG. 3, the back surface 30R of the right portion 26 of the strip 20 is imprinted with the first group of headings 40R, as well as with the first set of blank spaces 42R for reproducing first information entered in the first set of blank spaces 42L on the front surface 28L of the left portion 24. The first group of headings 40R on the back surface 30R of the right portion 26 is in longitudinal and transverse register with the first group of headings 40L on the front surface 28L of the left portion 24 when the right portion is folded along the centerline 22 "under" the left portion 24. The first set of blank spaces 42R on the back surface 30R of the right portion 26 is in longitudinal and transverse register with the first set of blank spaces 42L on the front surface 28L of the left portion 24 when the right portion 26 is folded along the centerline 22 under the left portion 24. The various headings and spaces are ommitted from FIG. 1, for clarity.

As is evident in FIGS. 1, 2 and 3, endmost pages 34*t* and 34*b* are provided at the top and bottom of the left portion 28 only. The back surface 30 of these pages are conveniently glued to the inside surfaces 16 and 18 of the front and back covers 12 and 14, respectively.

In use, the right portion 26 is folded under the left portion 24 and "first" information is entered in the first set of spaces 42L on the front surface 28L of the left portion 24. Means are provided for reproducing the first information, so entered on the front surface 28L of the left portion 24, on the back surface 30R of the right portion 26. The means for reproducing may be carbon paper, or the like.

Similarly, the right portion 26 is folded over the left portion 24 and "second" information is entered in the second set of spaces 46L on the back surface 30L of the left portion 24. Means are provided for reproducing the second information, so entered on the back surface 30L of the left portion 24, on the front surface 28 of the right portion 26. The means for reproducing may be carbon paper, or the like.

The headings 40L on the front surface 28L of the pages 34. 1L-34.12L of the left portion are shown in FIG. 2, and are exemplified by the following (as shown in FIG. 3, these headings are repeated, as 40R, as described hereinbefore, on the back surface 30R of the pages 34.1R-34.12R):

Page 34.1L—IDENTIFICATION, Name (followed by a space 42L for filling in), Address (followed by a space 42L for filling in), Phone (followed by a space 42L for filling in), Bus (business phone; followed by a space 42L for filling in), Date of Birth (followed by a space 42L for filling in), Birthplace (followed by a space 42L for filling in), and Soc Sec No (followed by a space 42L for filling in). The information filled in on the spaces 42L is reproduced on the the spaces 42R, as described hereinbefore.

The headings 44L on the back surface 30L of the pages 34.1L-34.12L of the left portion are shown in FIG. 3, and are exemplified by the following (as shown in FIG. 2, these headings are repeated, as 44R, as described hereinbefore, on the front surface 28R of the pages 34.1R-34.12R):

Page 34.1L—RELATIVES, Name (followed by a space 46L for filling in), Name (followed by a space 46L for filling in), Phone (followed by a space 46L for filling in), Name (followed by a space 46L for filling in), Phone (followed by a space 46L for filling in), and Name (followed by a space 46L for filling in), Phone (followed by a space 46L for filling in). The information filled in on the spaces 46L is reproduced on the the spaces 46R, as described hereinbefore.

The remaining headings 40L/40R and 44L/44R and spaces 42L/42R and 46L/46R are self-explanatory.

The front surface 28L of the page 34*t* is imprinted with general information about the use of the book 10, and may include a space for entering information, but this information will not be reproduced. The front surface 28L of the page **34*b*** is imprinted with general information about ordering the book, a copyright notice, etc. With respect to the copyright notice, it is intended that any copyright in the textual content of the book be preserved beyond the life of any patent issuing from the present patent application.

In a preferred embodiment of the invention, the strip 20 is treated with means for carbonless reproduction of the information entered.

Figure 4:
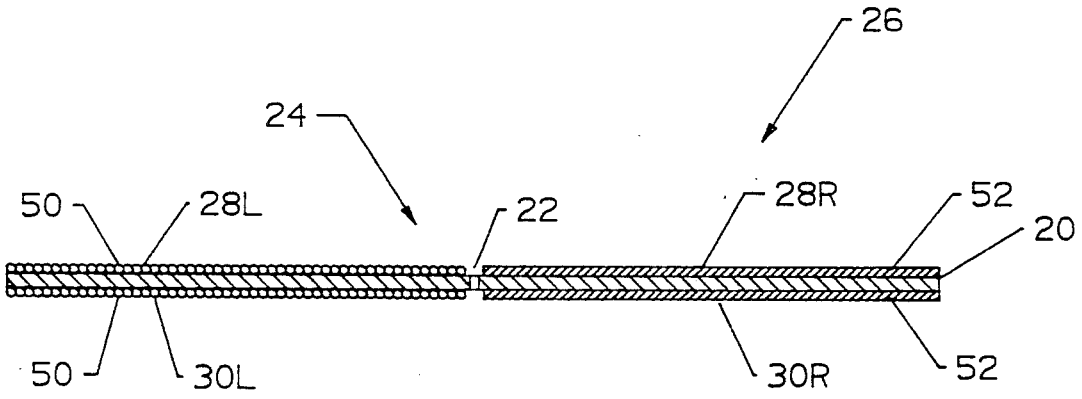
FIG. 4 is a transverse cross sectional view of the strip employed in the book of FIG. 1, taken on a line 4—4 through FIG. 2.

FIG. 4 shows a cross section of the strip 20. The thickness of the strip is grossly exaggerated for clarity. A "male" carbonless treatment 50 is applied to the front and back surfaces, 28L and 30L, of the left portion 24 of the strip 20. A "female" carbonless treatment 52 is applied to the front and back surfaces, 28R and 30R, of the right portion 26 of the strip 20. The perforated centerline 22 is visible in this view. The technology for applying the male and female carbonless treatments is well known, and has been described hereinbefore.

With respect to the strip 20 having dissimilar (i.e., male and female) carbonless (pressure-sensitive) treatments on the left and right portions, 24 and 26, it is within the scope of this invention that the boundary between the left and right portions 24 and 26 need not be a true centerline 22. It need not even be a straight line, so long as two or more portions are defined. It is possible that a strip of paper have three portions, a left portion, a center portion and a right portion, in which case one of the portions would be treated with carbonless male treatment both front and back, another of the portions would be treated with carbonless female treatment both front and back, and the remaining portion would be untreated or treated with either carbonless male or female treatment both front and back. It is further possible that the entire front or back surface of a portion would not be treated with the carbonless male or female treatment, but rather that the treatment is applied only to certain regions of the surface. This selective application of the treatment to only regions of a surface is generally known as "striping". It is even possible that only one of the front and back surfaces of a portion is treated. Therefore, such, and all of the variations discussed with respect thereto, is intentended to be within the scope of the present disclosure.

In use, after the first and second information has been entered and reproduced, as described above, the right portion 26 is separated from the left portion 24, thereby providing in the right portion 26 a duplicate copy of the first and second information. The left portion 24, which has the front and back covers 12 and 14 affixed thereto in book-like manner, is conveniently carried on the person, such as in a wallet. The right portion 26 is kept elsewhere. The front and back covers, being magnetized, tend to hold the book, containing the left portion, together.

It is evident that the folding of the right portion 26 "forward" (over the left portion 24) and "rearward" (under the left portion 24) along the centerline 22 in the course of entering information in the spaces on the left portion prestresses the centerline perforations, thereby facilitating the separation of the right portion 26 from the left portion 24.

As mentioned hereinbefore, worksheets are provided with the book to assist the user in recalling and filling in information in the spaces provided. For instance, for filling in any of the spaces associated with a heading "Other", a list of possible other, for instance, fixed assets/property (page 34.10L) would be provided.

The following terms have been used throughout the description of the invention: "front" and "back", in describing opposite surfaces of the strip; "left" and "right", in describing contiguous portions of the strip; "pages", in describing discrete areas of the strip defined by the accordion folds; "forward" and "rearward", in describing opposite folding movements; "over" and "under", in describing opposite folding directions; and "male" and "female" in describing the two cooperating parts involved in carbonless reproduction technology. While these terms should generally be given their everyday meaning, it is within the scope of this invention that they be liberally construed.

I claim:

1. A pocket-sized book comprising:

a front cover having an inside surface;

a back cover having an inside surface;

an accordion-folded strip of paper having accordion folds, a front surface, a back surface and two ends, said strip of paper perforated generally along a longitudinal centerline thereof, said centerline dividing the strip of paper into two portions, a "left" portion on one side of the centerline and a "right" portion on the other side of the centerline, the accordion folds disposed parallel to each other and perpendicular to the centerline and defining a plurality of "pages" between adjacent accordion folds, the left portion of the strip extending longitudinally further than the right portion and forming an end page at each of the two ends, the end pages so formed attached to the inside surfaces of the front and back covers, respectively; and further comprising:

means for reproducing information entered on the pages of the left portion onto the pages of the right portion.

2. A book according to claim 1, wherein:

the front surface of the left portion is imprinted with a first group of headings and includes a first set of areas for entering first information on the front surface of the left portion;

the back surface of the left portion is imprinted with a second group of headings and includes a second set of areas for entering second information on the back surface of the left portion;

the back surface of the right portion is imprinted with a third group of headings corresponding to the first group of headings and includes a third set of areas corresponding to the first set of areas for reproducing the first information entered in the first set of areas on the third set of areas, said third set of areas in register with the first set of areas when the right portion is folded along the longitudinal centerline of the strip "under" the left portion; and the front surface of the right portion is imprinted with a fourth group of headings corresponding to the second group of headings and includes a fourth set of areas corresponding to the second set of areas for reproducing the second information entered in the second set of areas on the fourth set of areas, said fourth set of areas in register with the second set of areas when the right portion is folded along the longitudinal centerline of the strip "over" the left portion.

3. A book according to claim 1, wherein:

the back surface of the left portion is treated with a male carbonless copy treatment and the back surface of the right portion is treated with a female carbonless copy treatment; and the front surface of the left portion is treated with a male carbonless copy treatment and the front surface of the right portion is treated with a female carbonless copy treatment.

4. A book according to claim 2, wherein:

the back surface of the left portion is treated with a male carbonless copy treatment and the back surface of the right portion is treated with a female carbonless copy treatment; and the front surface of the left portion is treated with a male carbonless copy treatment and the front surface of the right portion is treated with a female carbonless copy treatment.

5. A book according to claim 2, further comprising:

means for reproducing the first information entered in the first set of areas on the front surface of the left portion in the third set of areas on the back surface of the right portion when the right portion is folded along the centerline under the left portion, and for reproducing the second information entered on the second set of areas on the back surface of the left portion in the fourth set of areas on the front surface of the right portion when the right portion is folded along the centerline over the left portion.

6. A book according to claim 5, wherein the means for reproducing is carbon paper.

7. A book according to claim 2, further comprising:

a separate worksheet for organizing a draft of the first and second information prior to entering on the left portion.

8. A book according to claim 2 wherein:

the first and second group of headings include legends substantially indicative of the following:

identification, emergency, bank accounts, investments, fixed assets/property, relatives, insurance policies, employment benefit records, financial, personal advisors, and general information.

9. A book according to claim 1, wherein the book is pocket-sized.

* * * * *